US009011295B2

(12) United States Patent
Orenstein et al.

(10) Patent No.: US 9,011,295 B2
(45) Date of Patent: Apr. 21, 2015

(54) AEROBIC STEP

(75) Inventors: Amber Orenstein, Prior Lake, MN (US); Ben Ton, South El Monte, CA (US)

(73) Assignee: The Prophet Corporation, Owatonna, MN (US)

( * ) Notice: Subject to any disclaimer, the term of this patent is extended or adjusted under 35 U.S.C. 154(b) by 142 days.

(21) Appl. No.: 13/399,531

(22) Filed: Feb. 17, 2012

(65) Prior Publication Data

US 2013/0217545 A1 Aug. 22, 2013

(51) Int. Cl.

| | |
|---|---|
| ***A63B 22/04*** | (2006.01) |
| ***A63B 26/00*** | (2006.01) |
| ***A63B 23/04*** | (2006.01) |

(52) U.S. Cl.

CPC ..... *A63B 23/0458* (2013.01); *A63B 2210/00* (2013.01); *A63B 2225/62* (2013.01)

(58) Field of Classification Search

USPC ..... 482/34, 51, 52, 79, 80, 142, 146–148, 482/140; 441/74; D21/662, 671, 685, 760, D21/769; 472/102, 134, 135; 5/8, 902, 925

See application file for complete search history.

(56) References Cited

U.S. PATENT DOCUMENTS

| | | | | |
|---|---|---|---|---|
| 2,991,589 | A * | 7/1961 | Ayala | 446/192 |
| 3,421,163 | A | 1/1969 | Stoughton | |
| 3,628,790 | A * | 12/1971 | Gordon | 482/15 |
| 5,037,084 | A | 8/1991 | Flor | |
| 5,048,823 | A * | 9/1991 | Bean | 482/146 |
| 5,094,505 | A * | 3/1992 | Nichols | 297/118 |
| D330,057 | S | 10/1992 | Saunders et al. | |
| D330,234 | S | 10/1992 | Saunders et al. | |
| D330,235 | S | 10/1992 | Traetta et al. | |
| 5,154,678 | A | 10/1992 | Adamczyk et al. | |
| 5,158,512 | A | 10/1992 | Irwin et al. | |
| 5,169,360 | A | 12/1992 | Saunders | |
| 5,213,554 | A | 5/1993 | Goldstein et al. | |
| D337,362 | S | 7/1993 | Goldstein et al. | |
| 5,226,865 | A | 7/1993 | Chin | |

(Continued)

FOREIGN PATENT DOCUMENTS

WO WO 2009019702 A2 * 2/2009

OTHER PUBLICATIONS

BSN Sports, p. 219 (admitted as prior art as of filing date of Feb. 17, 2012).

(Continued)

*Primary Examiner* — Stephen Crow
*Assistant Examiner* — Gregory Winter
(74) *Attorney, Agent, or Firm* — Merchant & Gould P.C.

(57) ABSTRACT

An aerobic step includes a body having a middle exercise area and four sides. A maximum height of the body is positioned in the middle exercise area. The middle exercise area has a domed shape and curves downwardly to the four sides. The four sides define two longitudinal sides and two transverse sides. The middle exercise area includes a layer of material co-molded with and supported by a main body portion which promotes gripping and non-slippage. The layer of material includes a pattern of grooves. Two handles are defined along a lower portion of the body in the form of cutouts. An edge material is co-molded with and positioned on the lower edge of the body for contacting the ground. The body has a convex upper surface, and a concave lower surface which promotes stacking for storage, or for adding additional height by nesting two or more steps together.

16 Claims, 13 Drawing Sheets

(56) References Cited

U.S. PATENT DOCUMENTS

| | | | | |
|---|---|---|---|---|
| D339,179 | S | 9/1993 | Wilkinson | |
| D342,298 | S | 12/1993 | Schnabel, Jr. et al. | |
| 5,303,438 | A * | 4/1994 | Walker | 5/652 |
| D346,630 | S | 5/1994 | Van Der Hoeven | |
| 5,318,489 | A | 6/1994 | Irwin | |
| 5,330,399 | A | 7/1994 | Fan | |
| D350,450 | S | 9/1994 | Hassel et al. | |
| D353,636 | S | 12/1994 | Le Roux | |
| D355,226 | S | 2/1995 | Wadley | |
| D355,458 | S | 2/1995 | Chen | |
| 5,387,166 | A | 2/1995 | Gvoich | |
| D355,988 | S | 3/1995 | Brooking | |
| D360,767 | S | 8/1995 | Fish et al. | |
| 5,441,466 | A | 8/1995 | Piaget et al. | |
| D363,747 | S | 10/1995 | Gvoich | |
| 5,472,390 | A | 12/1995 | Faye | |
| D369,842 | S | 5/1996 | Gvoich | |
| D370,949 | S | 6/1996 | Furner | |
| D371,176 | S | 6/1996 | Furner | |
| 5,591,105 | A | 1/1997 | Dalebout et al. | |
| 5,656,000 | A | 8/1997 | Russell | |
| 5,749,555 | A | 5/1998 | Albrecht | |
| 5,842,955 | A | 12/1998 | Wilkinson | |
| D413,989 | S | 9/1999 | Dupont | |
| D429,106 | S | 8/2000 | Bortolotto et al. | |
| 6,234,088 | B1 | 5/2001 | Bredal et al. | |
| D449,357 | S | 10/2001 | Monter Villar et al. | |
| D449,662 | S | 10/2001 | Monter Villar et al. | |
| D489,423 | S | 5/2004 | Fan et al. | |
| 6,740,008 | B1 | 5/2004 | Ho et al. | |
| 6,872,175 | B2 * | 3/2005 | Lin | 482/146 |
| D507,026 | S * | 7/2005 | Chen | D21/671 |
| 6,945,919 | B2 * | 9/2005 | Yang | 482/142 |
| 7,004,886 | B2 * | 2/2006 | Chen | 482/14 |
| D519,172 | S | 4/2006 | Penat et al. | |
| 7,052,449 | B2 | 5/2006 | Chen | |
| 7,160,229 | B2 | 1/2007 | Park | |
| 7,169,099 | B1 | 1/2007 | Kemery et al. | |
| D562,918 | S * | 2/2008 | Tuller | D21/662 |
| 7,335,146 | B2 | 2/2008 | Gerstung | |
| 7,344,488 | B2 * | 3/2008 | Weck et al. | 482/147 |
| 7,374,517 | B2 * | 5/2008 | Lockett | 482/131 |
| 7,488,282 | B2 | 2/2009 | Leavitt | |
| 7,494,446 | B2 * | 2/2009 | Weck et al. | 482/47 |
| D590,457 | S | 4/2009 | Mishan | |
| D596,247 | S | 7/2009 | Wu | |
| 7,575,540 | B1 * | 8/2009 | Dobrow et al. | 482/142 |
| 7,591,763 | B1 | 9/2009 | Fucci | |
| D601,843 | S | 10/2009 | Cherry et al. | |
| 7,618,358 | B2 * | 11/2009 | Traub et al. | 482/147 |
| 7,657,952 | B2 | 2/2010 | Hutchison | |
| D612,896 | S * | 3/2010 | Talley | D21/686 |
| D626,607 | S | 11/2010 | Kim et al. | |
| D630,687 | S | 1/2011 | Meinel | |
| D632,101 | S | 2/2011 | Sandel et al. | |
| 7,922,624 | B1 | 4/2011 | Fairhurst et al. | |
| D642,638 | S | 8/2011 | Clark et al. | |
| D650,023 | S | 12/2011 | Everett | |
| D651,673 | S | 1/2012 | Kulzer | |
| D659,293 | S | 5/2012 | Ferguson | |
| 8,202,172 | B1 * | 6/2012 | LeJeune | 472/102 |
| D680,599 | S | 4/2013 | Orenstein et al. | |
| D717,381 | S * | 11/2014 | Orenstein et al. | D21/671 |
| 2004/0132594 | A1 | 7/2004 | Verna | |
| 2005/0020418 | A1 * | 1/2005 | Lin | 482/142 |
| 2005/0049123 | A1 * | 3/2005 | Dalebout et al. | 482/142 |
| 2006/0105894 | A1 | 5/2006 | Denoth et al. | |
| 2007/0225133 | A1 * | 9/2007 | Castro | 482/140 |
| 2009/0291807 | A1 | 11/2009 | Moring, Jr. et al. | |
| 2009/0307838 | A1 * | 12/2009 | Claffy et al. | 5/8 |
| 2010/0029443 | A1 | 2/2010 | Kim | |
| 2011/0143896 | A1 * | 6/2011 | Senegal | 482/139 |
| 2013/0023392 | A1 * | 1/2013 | Glickfield | 482/142 |

OTHER PUBLICATIONS

Flaghouse PE & REC catalog, front cover, pp. 251, rear cover (Spring 2011).
Gopher catalog, front cover, pp. 54, 266-268 and rear cover (2001).
Gopher catalog, front cover, pp. 238-241 and rear cover (Fall 2006).
Gopher catalog, front cover, pp. 269-275 and rear cover (Spring 2010).
Gopher catalog, front cover, pp. 268-271 and rear cover (2011).
Gopher catalog, front cover, pp. 268-271 and rear cover (Spring 2011).
Gopher catalog, front cover, pp. 266-268 and rear cover (2012) (admitted as prior art as of filing date of Feb. 17, 2012).
Long Cheng Exercise Equipment catalog, front cover, pp. 1-4, 35-42 (2010).
Sportime Physical Education & Recreation catalog, front cover, pp. 357-359 (Summer 2011).
The Step—Original Health Club Step (Gray/Black), *Escalade Sports*, 1 page (dated Feb. 15, 2012).
US Games, 1 page (admitted as prior art as of filing date of Feb. 17, 2012).
U.S. Appl. No. 29/413,673, filed Feb. 17, 2012 entitled "Aerobic Step".
U.S. Appl. No. 29/447,718, filed Mar. 6, 2013.
Ex Parte Quayle Action for U.S. Appl. No. 29/447,718, mailed May 29, 2013.

* cited by examiner

AEROBIC STEP

FIELD OF THE INVENTION

The present invention relates to an aerobic or exercise step.

BACKGROUND

Aerobic, fitness, or exercise steps are used by individuals to do various exercises and activities for exercise to improve one's health, for rehabilitation, or for other reasons. Various steps are known which allow the user to elevate oneself a distance from the ground. There is a continuing need for improvements in aerobic, fitness or exercise steps (herinafter referred to as an "aerobic step" or "step").

SUMMARY

The present invention concerns an aerobic step which includes a middle exercise area and four sides. The body defines a height, a length extending in a longitudinal direction and a width extending in a transverse direction. The middle exercise area allows a user to contact the body of the step and perform one or more exercises or activities using the step.

In one preferred embodiment, the body defines a domed shape with the highest point in the middle exercise area, with the body tapering downwardly toward the ground toward all four sides.

Preferably, the domed shape defines a convex curve which curves downwardly to the four sides.

In a further preferred embodiment, the body has a longer length than the width.

In one preferred embodiment, the body includes an outer periphery which contacts the floor in one or more continuous portions about the outer periphery. In one embodiment, two handles are provided along the outer periphery in the form of cutouts. In one preferred embodiment, the outer periphery contacts the floor in a continuous line except for in the two handle areas. The handle areas are preferably located along two of the longitudinal sides.

In one preferred embodiment, the middle exercise area provides good griping contact between the user and the step. In one embodiment, the middle exercise area is supported by a unitary body portion which extends underneath the middle exercise area down to the outer periphery. Preferably, a similar gripping type material is positioned on the lower surface of the body which promotes non-sliding or griping action with the ground.

In one preferred embodiment, the middle exercise area has gripping surfaces or edge portions in the form of a texture or a pattern of edge surfaces. One pattern is a plurality of grooves.

In one preferred embodiment, the body of the aerobic step defines an upper convex surface and a lower concave surface underneath the middle exercise area. Support ribs extend underneath and define the lower concave surface to provide structural support for the body portion.

One preferred use of the aerobic step with the upper convex surface and the lower concave surface is that the device is stackable with one or more identically configured aerobic steps. One purpose for stacking is for compact storage. Preferably, the aerobic steps self-stack when arranged generally vertically in alignment with the longitudinal and transverse sides in alignment.

A second purpose of the upper convex and lower concave surfaces of the aerobic step is to provide additional height to the user. In one embodiment, the aerobic step has a height of about eight inches or less. Preferably, the height is about six inches. The additional height can be added to a single aerobic step by adding a second aerobic step. Preferably, the additional height added by the additional aerobic step is in relatively small increments, such as four inches or less. Preferably, the height addition is about two inches.

When six aerobic steps are stacked together, such as for storage, the height is preferably twenty inches or less. Preferably, the height is about sixteen inches.

When stacking the steps for storage or for use in exercising, the inner concave surface of the top step generally closely follows the outer convex surface of the underneath step.

DETAILED DESCRIPTION OF THE PREFERRED EMBODIMENT

Figure 1:
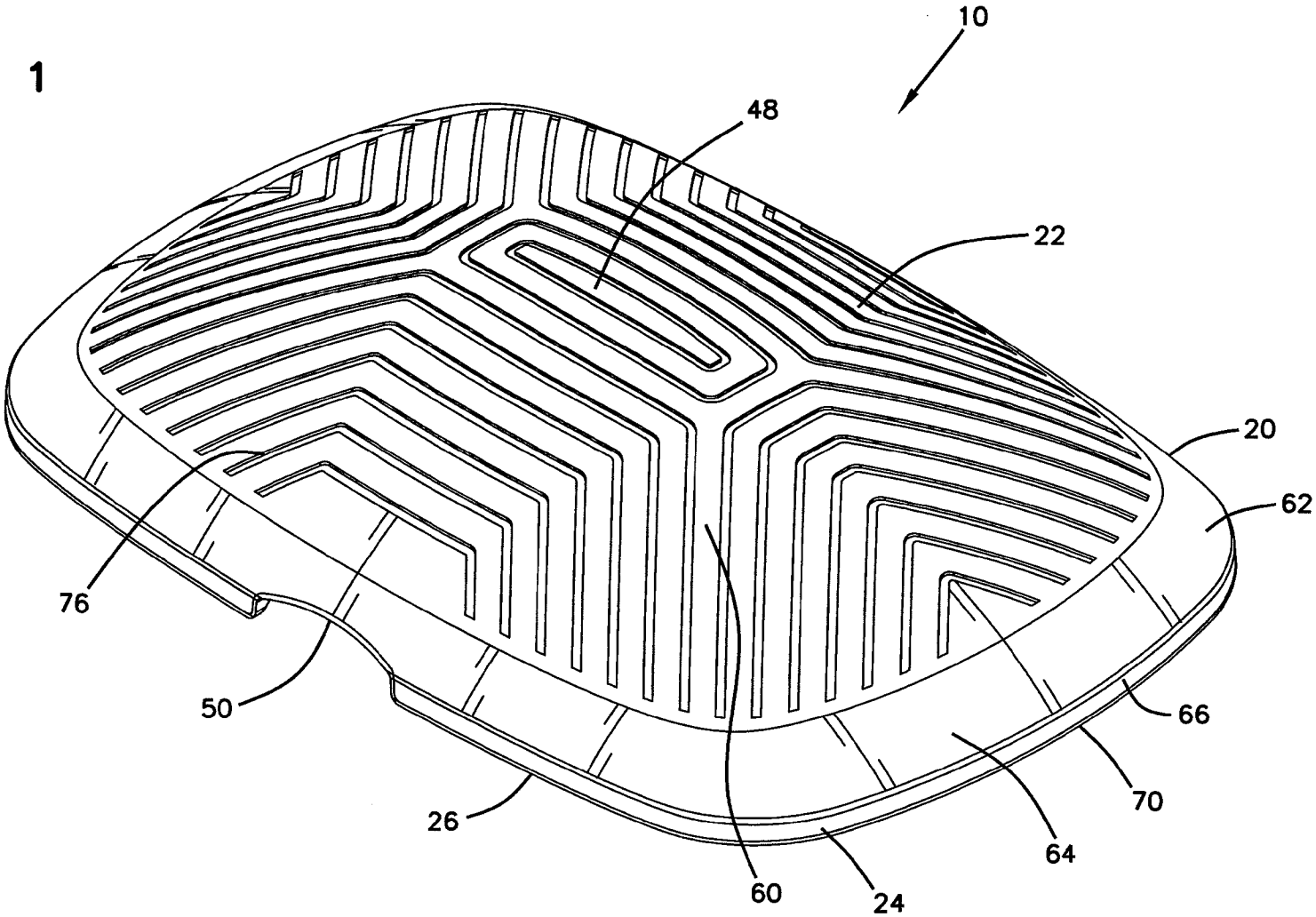
FIG. 1 is a perspective view of one embodiment of an aerobic step.
Figure 2:
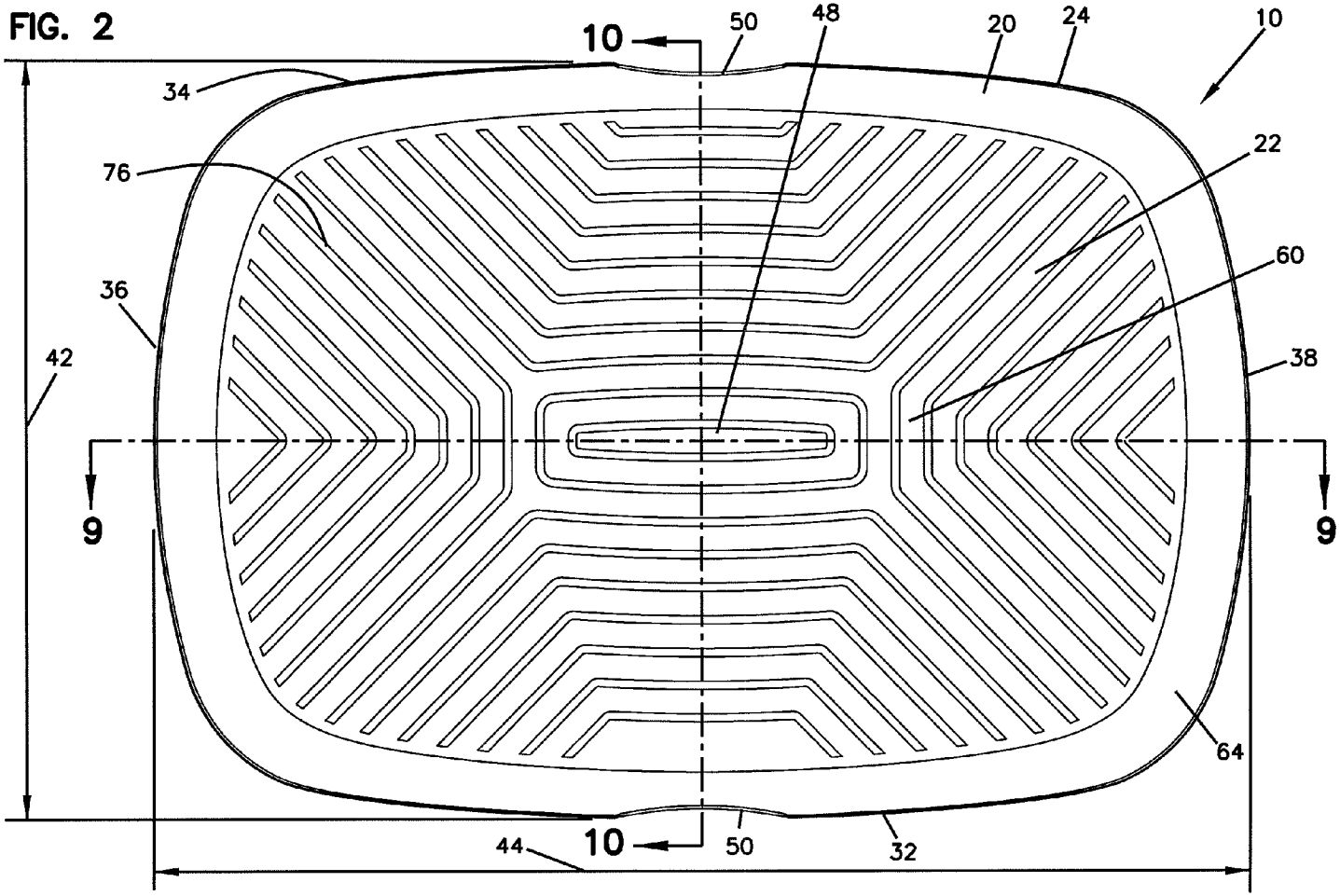
FIG. 2 is a top view of the aerobic step of FIG. 1.

Referring now to FIGS. 1-12, an aerobic step 10 is shown. Aerobic step 10 can also be referred to as an exercise step, fitness step, exercise device or therapy device. Aerobic step 10 can be used in a varieties of manners for exercise or rehabilitation by the user. The user can step on and off step 10 in a variety of manners. Also, step 10 can be used if desired as a support for different body parts for different exercises.

Step 10 includes a body 20 having an upper surface 22, an edge or outer periphery 24 and a lower surface 26 which engages the ground. An inner surface 30 faces in a opposite direction to upper surface 22. Body 20 includes four sides 32, 34, 36, 38. Upper surface 22 has a convex shape. Inner surface 30 has a concave shape.

In the illustrated body, body 20 has a height 40, a width 42 and a length 44. As shown, length 44 is longer than width 42. Body 20 has a generally domed shape with the maximum height 40 at the central portion 48.

Body 20 defines a domed shape wherein central portion 48 defines the highest point and which tapers or curves downwardly toward outer periphery 24. This can be seen by viewing FIGS. 1, 3, and 4.

Longitudinal sides 32, 34 are longer than transverse sides 36, 38. Longitudinal sides 32, 34 define lower handles 50 in the form of cutouts. Otherwise, in the preferred embodiment, the entirety of transverse sides 36, 38, and the longitudinal sides 32, 34, except for the areas of handles 50, define lower surface 26 for contacting the ground in two continuous strips 54 in the illustrated embodiment.

Figure 3:
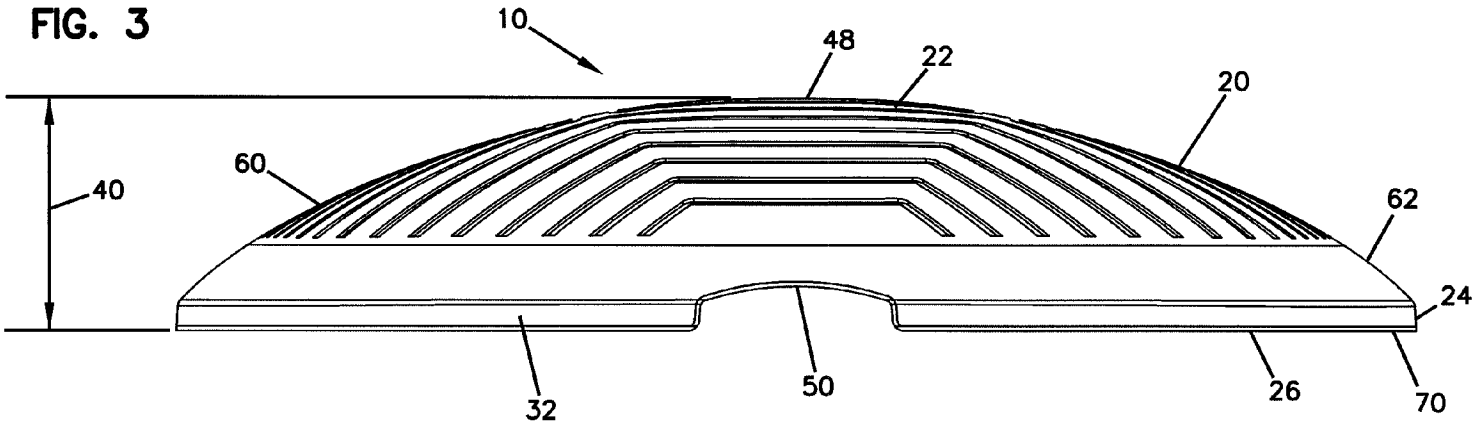
FIG. 3 is a side view of the aerobic step of FIG. 1, with an opposite side being identical.
Figure 4:
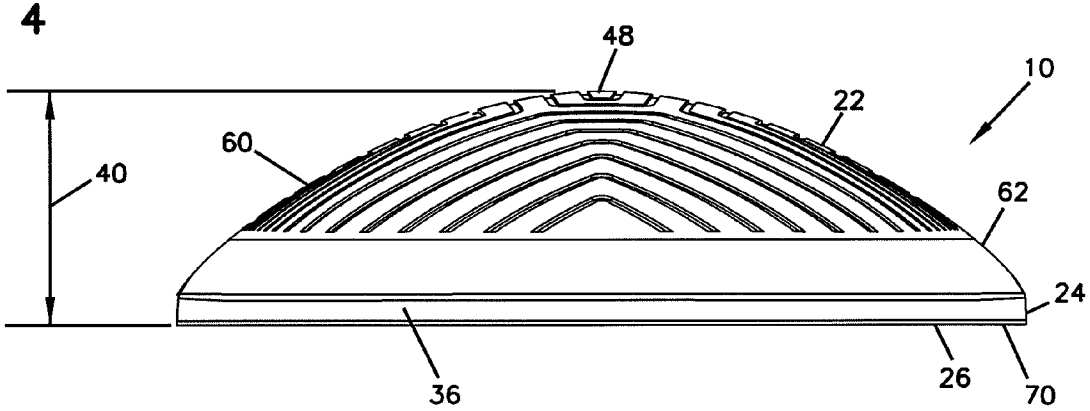
FIG. 4 is another side view of the aerobic step of FIG. 1, with the opposite side being identical.

Upper exercise area 60 generally forms a majority of upper surface 22. In the preferred embodiment the body 20 includes a main body portion 62 which supports upper exercise area 60. Main body portion 62 also includes side body portions 64 which are located outside of upper exercise area 60. Side body portions 64 generally extend in a continuous curve with upper exercise area 60, as shown in FIGS. 1, 3, and 4. There is preferably a smooth transition from side body portions 64 to upper exercise area 60. Side body portions 64 also include lower edge portions 66 which extend generally vertically.

Upper exercise area 60 is supported by main body portion 62 and can be made from a different material. For example, main body portion 62 can be made from a molded plastic material with the good structural integrity to support a user contacting upper exercise area 60 including standing or jumping on upper exercise area 60. Preferably, main body portion 62 is fairly rigid, and does not flex significantly. For example, it is preferable that main body portion 62 not flex like an inflated bladder or chamber would as in some exercise equipment. Upper exercise area 60 is in sheet form or layer shape and fits in a pocket 68 in main body portion 62.

Upper exercise area 60 is preferably made from a different material supported by main body portion, wherein upper exercise area 60 can be made from a material which promotes gripping and non-slippage relative to a user who contacts upper exercise area 60. In one example, upper exercise area 60 is continuous and co-molded with main body portion 62. For example, upper exercise area 60 can be made from a thermoplastic rubber which is co-molded with main body portion 62 made from a fairly rigid plastic material, such as polypropylene. Main body portion 62 is generally made so as to support several hundred pounds.

Upper exercise area 60 can also be provided with a pattern or texture to further promote grip and non-slippage with the user. As shown, upper exercise area 60 includes a plurality of linear grooves 76. Other patterns and/or textures can be provided to promote grip and non-slippage.

Referring now to FIGS. 1-12, lower gripping portion 70 forms the ground engaging surface of body 20 and can be formed from the same material as upper exercise area 60. Lower gripping portion 70 can also be co-molded with main body portion 62. As shown, lower gripping portion 70 forms a continuous shape which goes all the way around the outer periphery 24 of body 20, including also in the area of the handles 50. Lower gripping portion 70 can be molded up into grooves or channels in main body portion 62 as shown in FIGS. 7-12.

Figure 5:
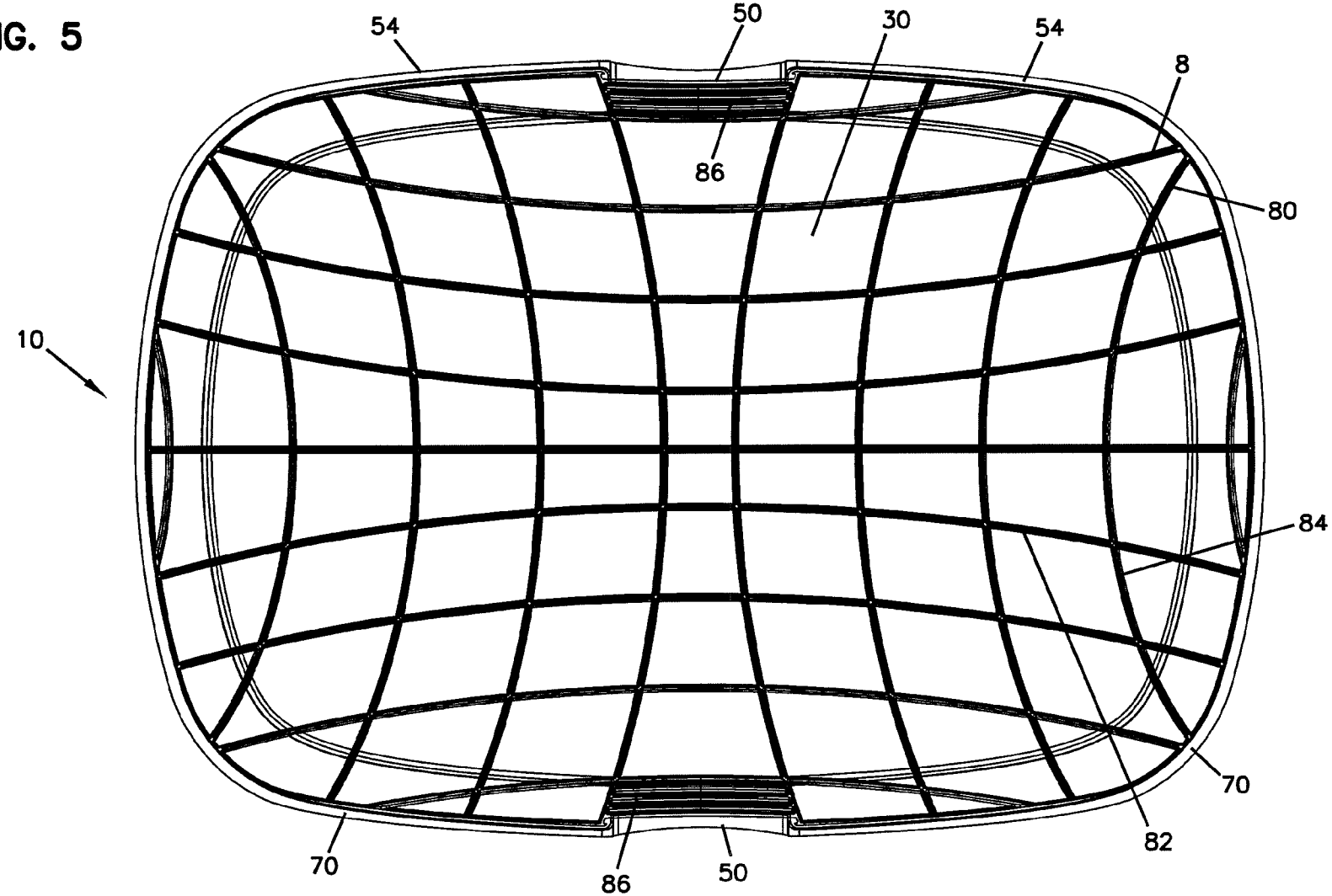
FIG. 5 is a bottom view of the aerobic step of FIG. 1.
Figure 6:
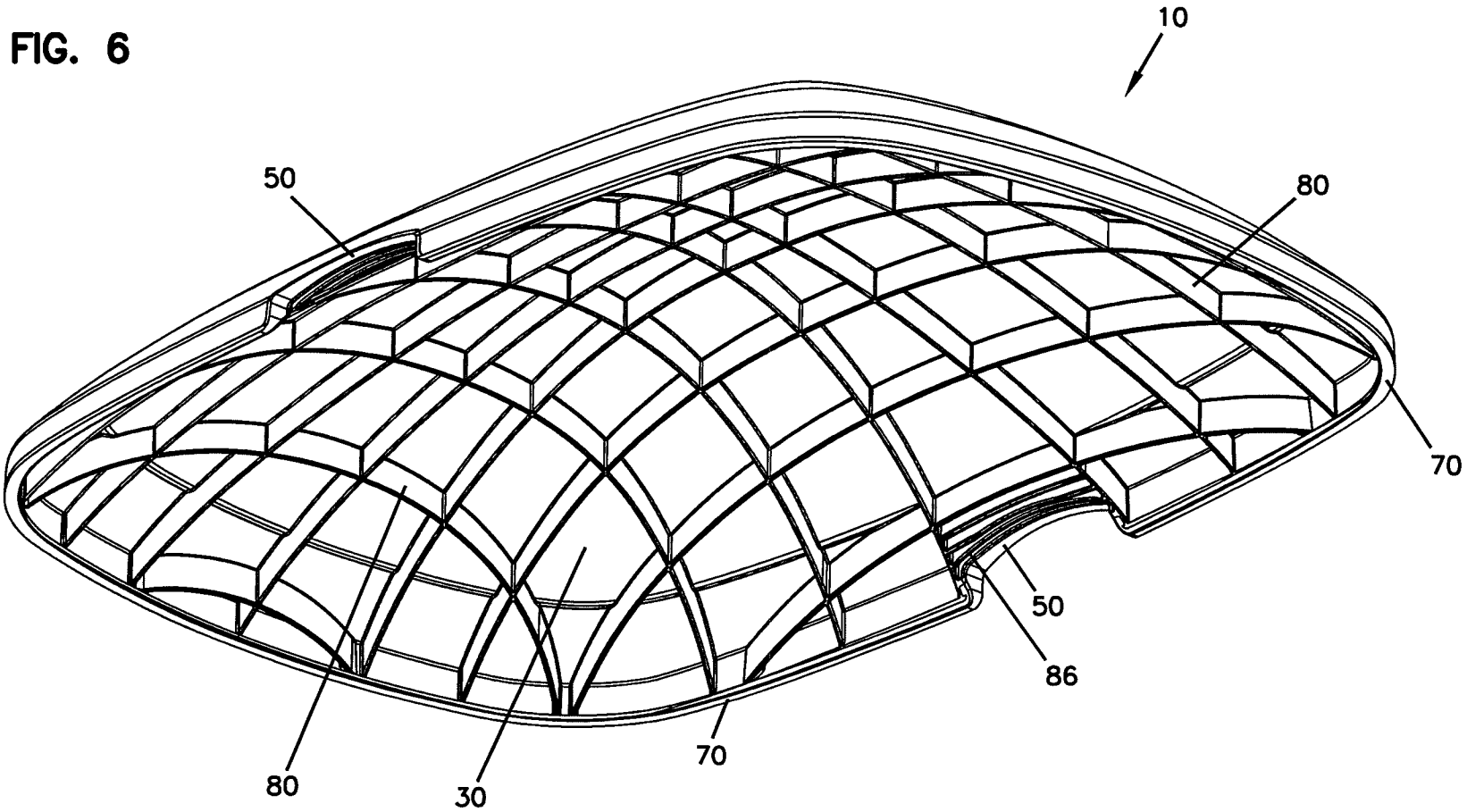
FIG. 6 is a bottom perspective view of the aerobic step of FIG. 1.
Figure 7:
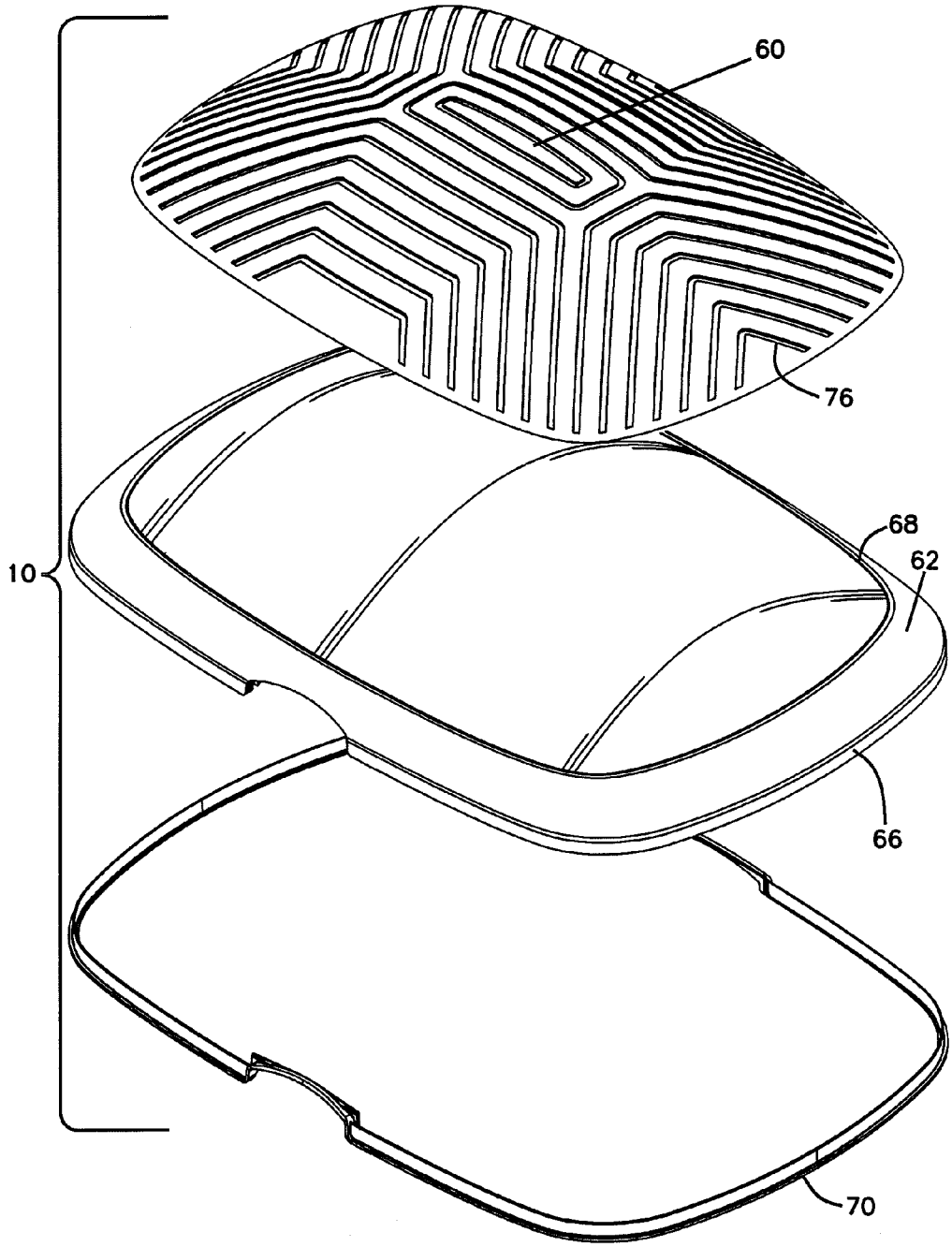
FIG. 7 is an exploded view of the aerobic step of FIG. 1, taken in top perspective.
Figure 8:
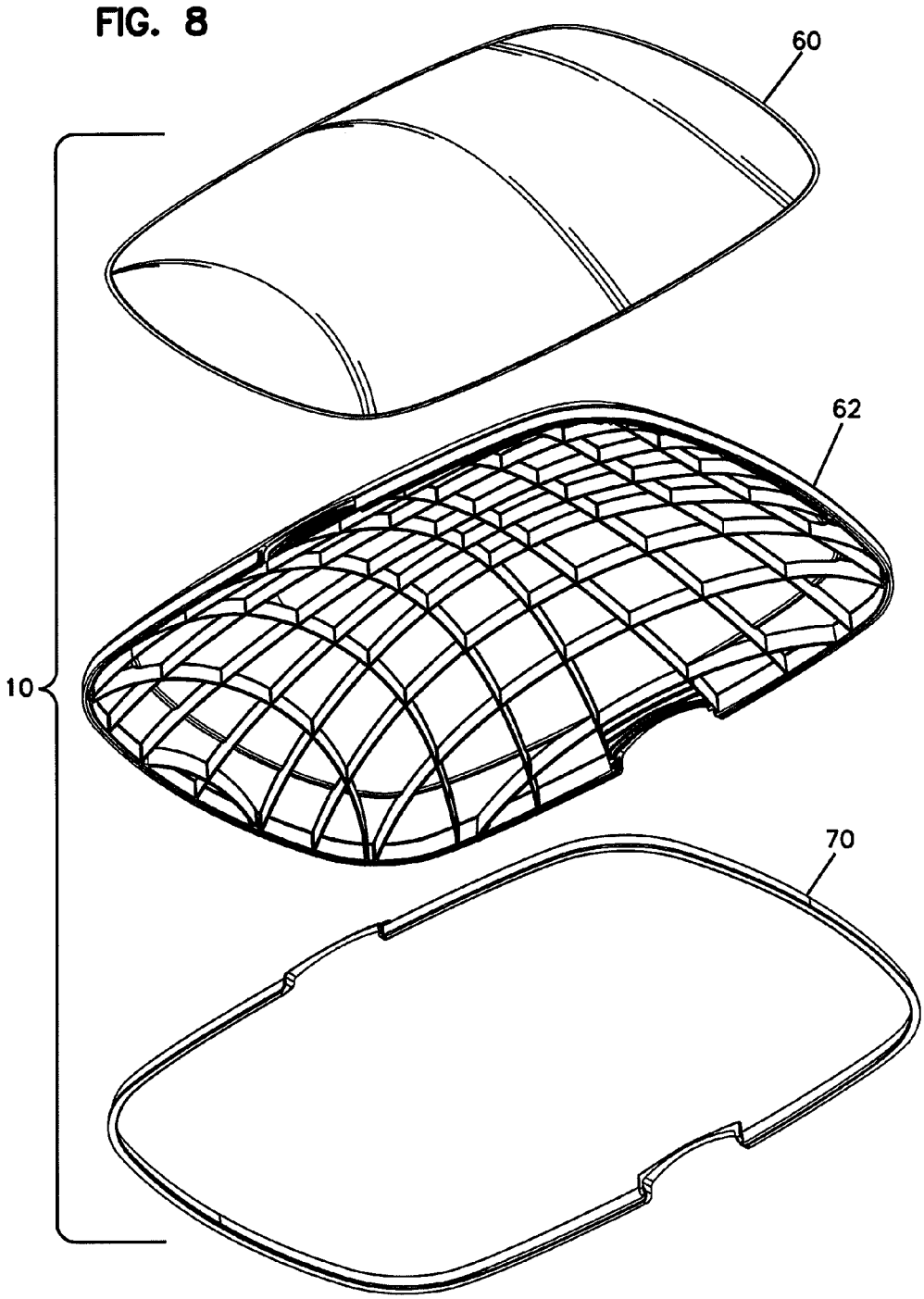
FIG. 8 is an exploded view of the aerobic step of FIG. 1, taken in bottom perspective view.
Figure 9:
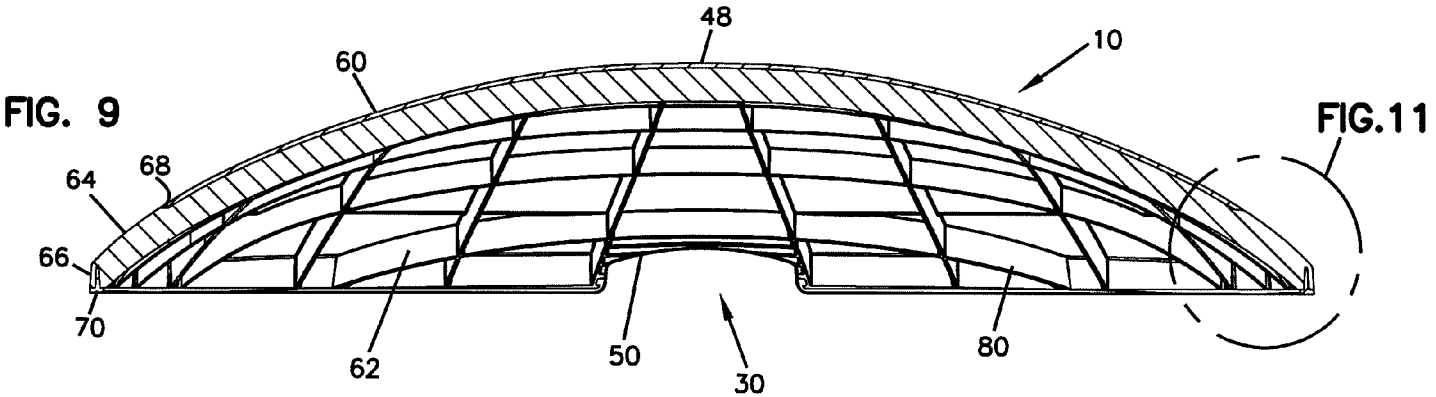
FIG. 9 is a cross-sectional view of the aerobic step of FIG. 1, taken along lines 9-9 of FIG. 2.
Figure 10:
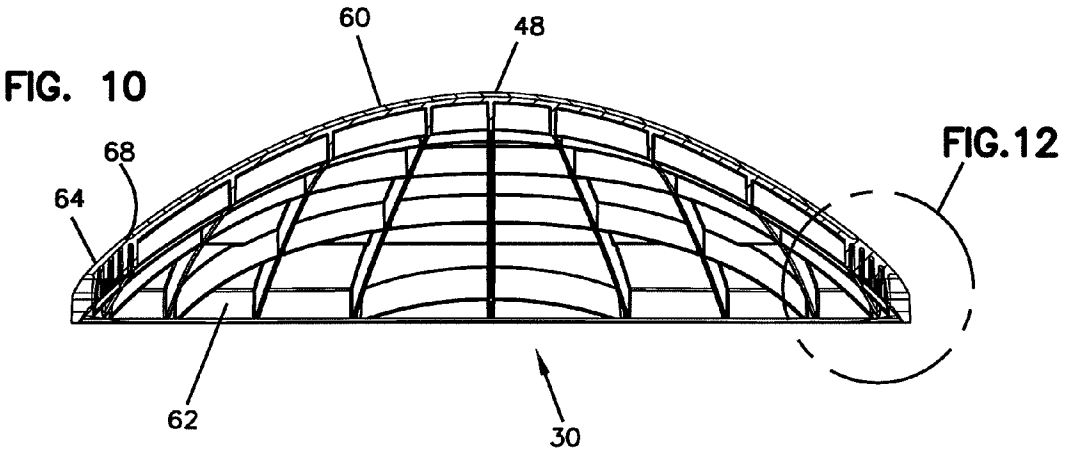
FIG. 10 is a cross-sectional view of the aerobic step of FIG. 1, taken along lines 10-10 of FIG. 2.
Figure 11:
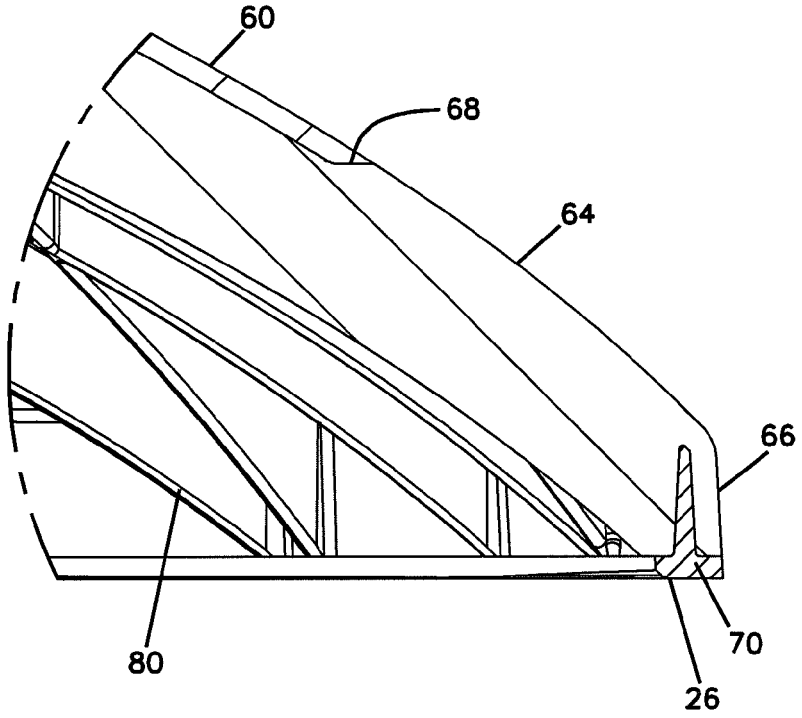
FIG. 11 is an enlarged view of a portion of the cross-section of FIG. 9.
Figure 12:
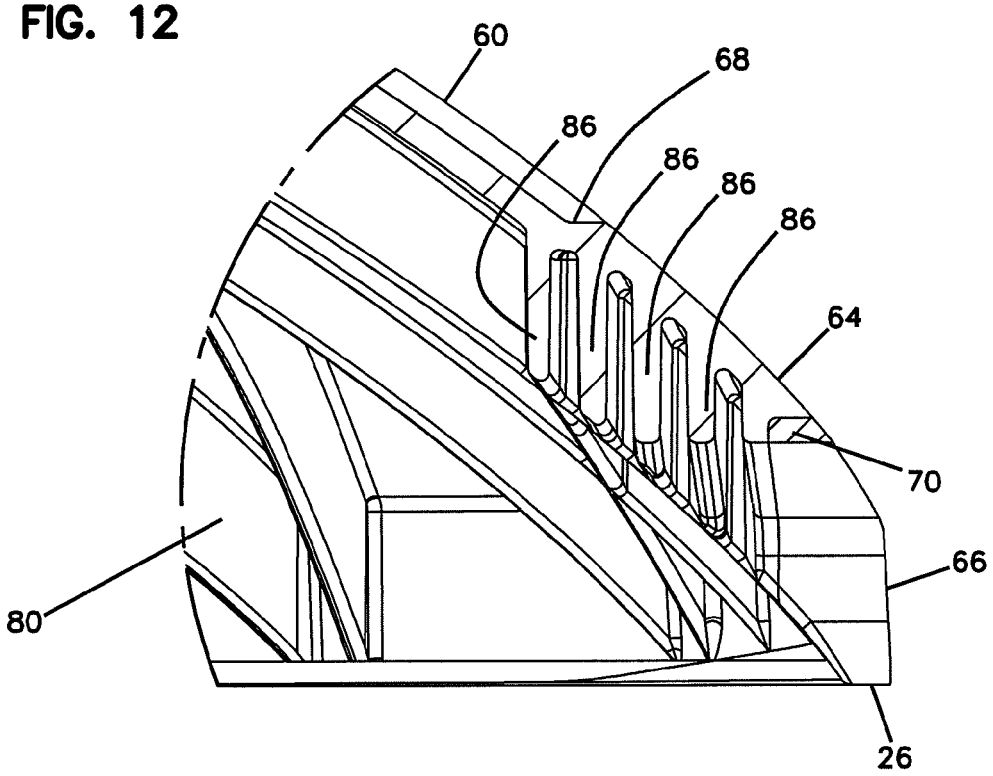
FIG. 12 is an enlarged view of a portion of the cross-section of FIG. 10.

Referring now to FIGS. 5, 6, and 8, inner surface 30 includes a plurality of ribs 80. The ribs 80 can be formed in a variety of patterns as desired, for strength. As shown, longitudinal ribs 82 and transverse ribs 84 are provided. Additional side ribs 86 are provided adjacent handles 50 for strength and comfort. Side ribs 86 are shorter and closer together and provide a convenient gripping area for the user to hold step 10 with two hands, one in each handle 50. Step 10 can also be held with one hand on one handle 50, by curling the fingers under and around side ribs 86.

In one embodiment, the aerobic step 10 has a height of about eight inches or less. Preferably, the height is about six inches. The additional height can be added to a single aerobic step 10 by adding a second aerobic step 10. Preferably, the additional height added by the additional aerobic step is in relatively small increments, such as four inches or less. Preferably, the height addition is about two inches.

Figure 13:
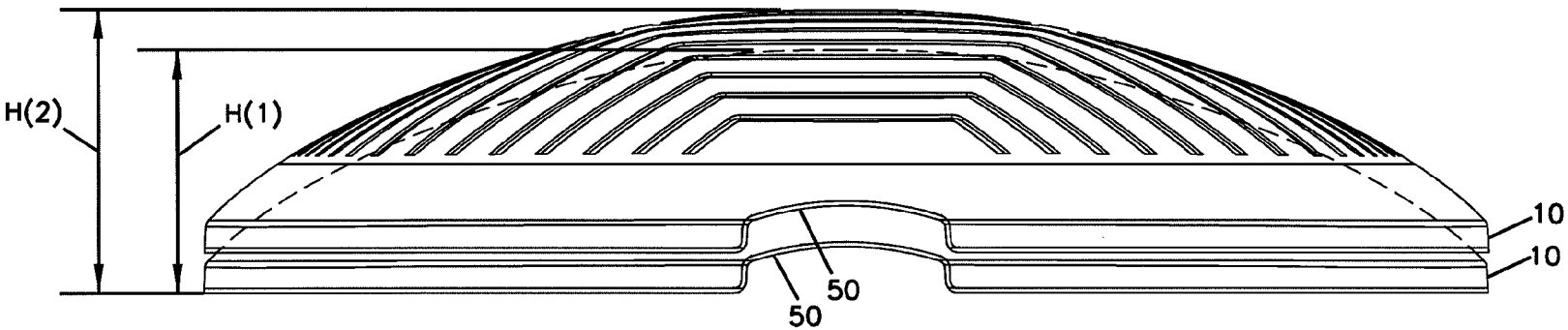
FIG. 13 shows two aerobic steps in a stacked arrangement from the side view.
Figure 14:
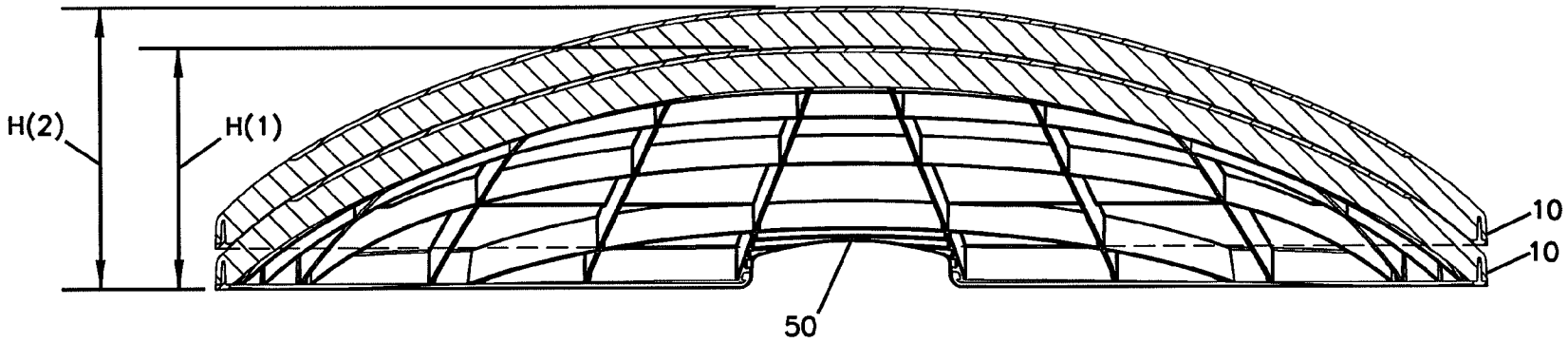
FIG. 14 shows the two stacked aerobic steps in cross-section from FIG. 13.

Inner surface 30 defines a concave shape, and upper surface 22 defines a convex shape. Such a configuration allows for multiple steps 10 to be nested within one another as shown in FIGS. 13-16. One advantage of nesting steps 10 is that an increased height can be provided, such as shown in FIG. 13, for a user wanting an additional height for use during exercise. For example, if one step 10 is about six inches high for maximum height, adding a second step 10 will increase the height. In the example shown, adding the second step adds an additional height, such as about two inches. This allows for greater flexibility for the user who may not want larger increases in height. Also, the nesting shapes provide for stable support of the user standing or being supported by the top step 10.

Figure 15:
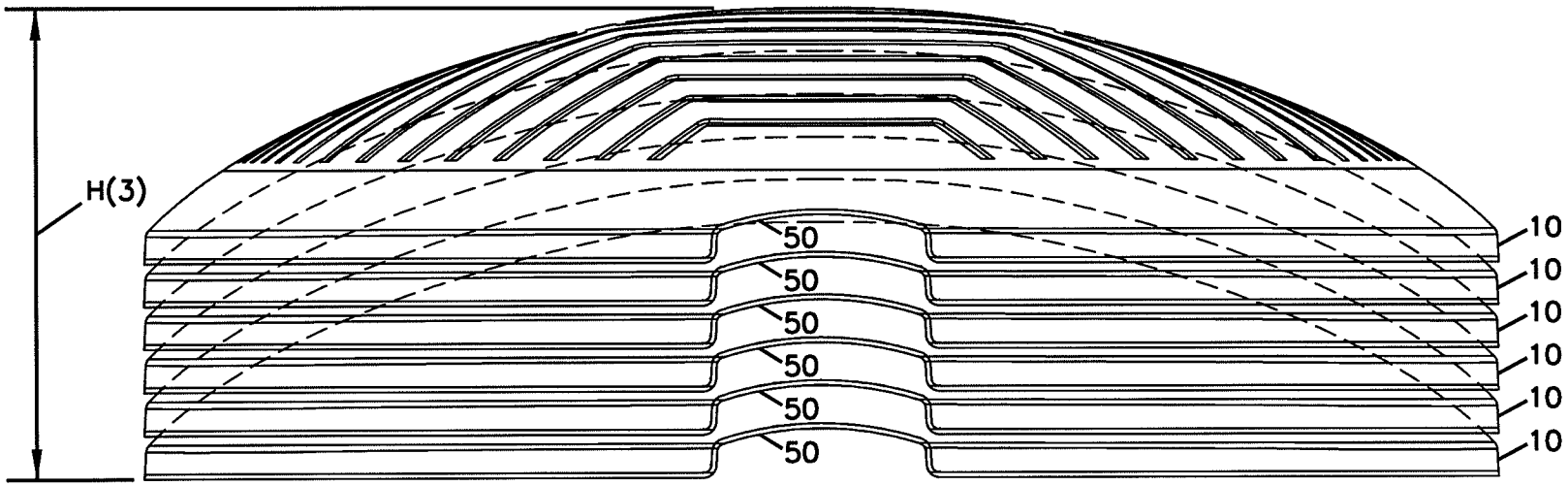
FIG. 15 shows six aerobic steps in a stacked arrangement from the side view.
Figure 16:
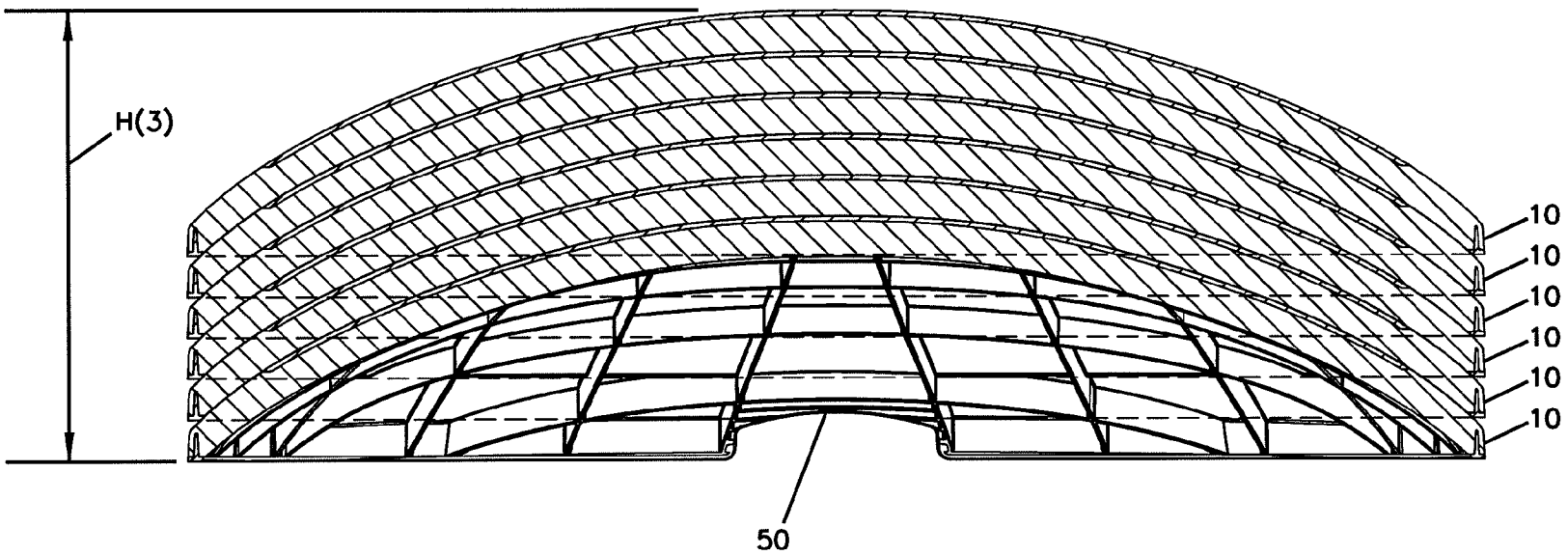
FIG. 16 shows the stack of aerobic steps of FIG. 15 in cross-section.

As shown in FIGS. 15 and 16, a stack of six steps 10 is fairly compact, for example having a maximum height of about 16 inches.

As noted above, body 20 has a somewhat rectangular outer perimeter with a domed upper surface and a concave underneath surface. One advantage of the domed upper surface is that no defined or sharp edges are provided which a user could misstep and injure oneself. Another advantage is the ability to conveniently stack. A still further advantage is that when stacking multiple steps 10, small increments in height are added for each step 10.

It is preferred that step 10 be less than or equal to forty inches long in length direction 44, thirty inches wide in width direction 42, and eight inches tall in height direction 40. More preferably, it is preferred that step 10 be about 32 inches long, 22 inches wide, and 6 inches high. When stacking two steps together, it is preferred that the stack be ten inches or less. More preferably it is preferred that the stack be about eight inches. Each step preferably adds about two inches to the top height (compare H(1) to H(2)). Step 10 does not need a riser to increase the exercising height of the step 10. When stacking six steps 10 it is preferred that the stack be twenty inches or less, and preferably about sixteen inches or less (see H(3)).

In one embodiment, lower edge portion 66 is about 1 inch high. Side body portion 64 is about 3 inches long extending from lower edge portion 66 to upper exercise area 60.

As shown and described, it is preferred that step 10 be fairly rigid and not provide bounce when a user would step or jump on step 10. Further, it is preferred that upper surface 22 generally not have any significant flat areas, or sharp corners.

Further, it is preferred that upper surface 22 provide a good gripping surface so as to prevent slippage by a user. Also, it is preferred that lower surface 26 provide a good ground gripping surface, and be fairly long, such as extending around a large percentage of the outer periphery. In the example shown, lower surface 26 engages the ground in all areas of the outer periphery 24 except at the cutouts which form handles 50.

The domed shape of upper surface 22 of step 10 allows for a variety of stepping or stretching exercises to be done by the user. The user can step on the top or the sides of area 60. The user can also use the step 10 to balance on by standing, or lying on step 10 with various parts of the body. The user can do various exercises like pushups using the step 10. If desired, the user can jump over step 10 during exercising.

Because side body portions 64 and lower gripping portion 70 are adjacent the ground there is no gap for a user to catch a foot or hand on during exercising.

What is claimed is:

1. An aerobic step comprising:

a support body having a lower edge portion extending downwardly from an outer periphery of an upper surface, the outer periphery having opposite longitudinal sides extending between opposite transverse sides, the longitudinal sides being longer than the transverse sides, the upper surface defining a pocket and a side body portion that extends between the pocket and the outer periphery, the lower edge portion being configured to engage a ground surface, the support body also defining an inner surface that faces in an opposite direction to the upper surface, the inner surface having a concave shape that follows a contour of the upper surface;

a layer of material disposed in the pocket of the support body, the layer of material having a concavely curved inner surface that contacts a convexly curved surface of the pocket, the layer of material having a convexly curved outer surface that cooperates with the side body portion to define a convex shape of the aerobic step;

wherein the convex shape of the aerobic step defines a domed longitudinal shape and a domed transverse shape with a highest point of each domed shape being located at a center of the layer of material.

2. The step of claim 1, wherein handles are defined by cutouts through the lower edge portion of the support body.

3. The step of claim 1, wherein the layer of material includes a plurality of inner edges.

4. The step of claim 3, wherein the layer of material includes a pattern of grooves.

5. The step of claim 1, wherein the lower edge portion of the support body defines a continuous strip except in two cutout areas.

6. The step of claim 5, wherein a gripping material is positioned on a bottom of the lower edge portion.

7. The step of claim 5, wherein the two cutout areas define handles.

8. The step of claim 7, wherein a gripping material is positioned on a bottom of the lower edge portion.

9. The step of claim 1, wherein:

the layer of material is co-molded with the support body.

10. The step of claim 9, wherein the layer of material includes a pattern of edges.

11. The step of claim 10, wherein the layer of material includes a pattern of grooves.

12. The step of claim 9, wherein a grip covering is positioned on a bottom of the lower edge portion, wherein the grip covering and the layer of material are made from the same rubber, and wherein the support body is more rigid than the rubber.

13. The step of claim 12, wherein the grip covering is co-molded with the support body.

14. The step of claim 2, wherein each of the cutouts also extends through the side body portion.

15. The step of claim 1, wherein the side body portions extend in a continuous curve with the convexly curved outer surface.

16. The step of claim 1, wherein the support body does not flex significantly compared to an inflatable bladder.

* * * * *